US006044130A

United States Patent [19]

Inazura et al.

[11] Patent Number: 6,044,130

[45] Date of Patent: Mar. 28, 2000

[54] TRANSMISSION TYPE X-RAY TUBE

[75] Inventors: Tsutomu Inazura; Kenji Suzuki, both of Hamamatsu, Japan

[73] Assignee: Hamamatsu Photonics K.K., Shizuoka, Japan

[21] Appl. No.: 09/113,371

[22] Filed: Jul. 10, 1998

[51] Int. Cl.[7] ..... H01J 35/14

[52] U.S. Cl. ..... 378/138; 378/143

[58] Field of Search ..... 378/138, 143

[56] References Cited

U.S. PATENT DOCUMENTS 4,669,173 6/1987 Valkonet ..... 378/143

FOREIGN PATENT DOCUMENTS 37-5501 6/1962 Japan .

A-48-52390 7/1973 Japan .

A-57-187848 11/1982 Japan .

A-10-106463 4/1998 Japan .

*Primary Examiner*—Craig E. Church

*Attorney, Agent, or Firm*—Oliff & Berridge, PLC

[57] ABSTRACT

A transmission type X-ray tube is provided with a ceramic stem fitted with cathode pins; an output window, the lower surface of which is deposited with a target metal; a ceramic bulb provided between the ceramic stem and the output window; and a focusing electrode provided along the inner surface of the ceramic bulb and which lower end is interposed between the upper surface of the ceramic stem portion and the lower end of the ceramic bulb. With this configuration, not only can the size of the X-ray tube be reduced, but mounting of the focusing electrode can also be made easier, thereby simplifying assembly operations.

15 Claims, 9 Drawing Sheets

TRANSMISSION TYPE X-RAY TUBE

BACKGROUND OF THE INVENTION

1. Field of the Invention

The present invention relates to a transmission type X-ray tube being reduced in size while retaining voltage resistivity.

2. Description of the Prior Art

In an X-ray tube, electrons emitted from a heating filament are accelerated by high voltage applied between a cathode and anode within a tube in high vacuum and collide with an anode target surface opposing the cathode, generating X-rays. X-ray tubes include such medical uses as CT scanning and such industrial uses as nondestructive inspections and thickness measurements. There are various constructions for this X-ray tube in the prior art, as disclosed in Japanese Laid-Open Patent Publications (Kokai) Nos. SHO-57-187848 and SHO-48-52390.

However, the above-described medical and industrial X-ray tubes are large, and with the current trend of reducing the size of such products as air cleaners there is a demand for smaller X-ray tubes, as well. It is possible to greatly reduce the size of X-ray tuber by depositing a focusing electrode on the inner surface of the bulb, which forms the X-ray tube. However, depositing a focusing electrode on the inner surface of the bulb decreases the space between the point at which the target and bulb meet and the point at which the focusing electrode and bulb meet. As a result, voltage resistivity cannot be maintained.

SUMMARY OF THE INVENTION

It is an object of the present invention to provide a transmission type X-ray tube capable of both having a reduced size and maintaining voltage resistivity.

In order to achieve the above and other objects, the present invention provides a transmission type X-ray tube including a ceramic stem fitted with a pair of cathode pins; an output window, the lower surface of which is deposited with a target metal; a ceramic bulb provided between the ceramic stem portion and the output window; and a focusing electrode provided along the inner peripheral surface of the ceramic bulb and which lower end is interposed between the upper surface of the ceramic stem portion and the lower end of the ceramic bulb. Hence, not only can the size of the X-ray tube be reduced, but mounting of the focusing electrode can also be made easier, thereby simplifying assembly operations.

The transmission type X-ray tube can be further provided with a conductive target voltage application cap for applying target voltage to the output window. This conductive target voltage application cap can protect the output window and prevent it from cracking. Also, the conductive cap can prevent the output window from slipping due to vibrations generated when brazing the output window to the ceramic bulb.

The transmission type X-ray tube can be further provided with separation means for separating the inner peripheral surface of the ceramic bulb and the outer peripheral surface of the focusing electrode. Hence, a gap is formed between the ceramic bulb and the focusing electrode. Also, a long distance can be reserved between the point at which the output window and ceramic bulb meet and the point at which the focusing electrode and ceramic bulb meet. As a result, voltage resistivity can be maintained.

The separation means can be a slanted portion provided around the periphery of the focusing electrode. Hence, when the ceramic bulb is placed over the focusing electrode, the lower end of the ceramic bulb contacts the slanted portion provided on the focusing electrode. The ceramic bulb can be slipped over the slanted portion of the focusing electrode to create a gap between the outer surface of the focusing electrode and the inner surface of the ceramic bulb. Once the ceramic bulb has been positioned, the bulb will not slip on the slanted portion. Accordingly, it is possible to prevent a reduction in voltage resistivity caused by brazing material moving between the focusing electrode and the ceramic tube as a result of the bulb slipping.

The separation means can also be a stepped portion provided around the peripheral of the focusing electrode. With this stepped portion, it is possible to prevent vibrations of the focusing electrode, as well as to separate the ceramic bulb and the focusing electrode.

The separation means can also be a protruding edge provided around the lower end periphery of the ceramic bulb. With this protruding edge, it is possible to prevent vibrations of the focusing electrode, as well as to separate the ceramic bulb and the focusing electrode.

The separation means can also be a ring spacer provided between the inner surface of the ceramic bulb and the outer surface of the focusing electrode. Hence, the ceramic bulb and the focusing electrode can be separated without complicating the shape of either.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

A transmission type X-ray tube according to a preferred embodiment of the present invention will be described while referring to the accompanying drawings.

Figure 2:
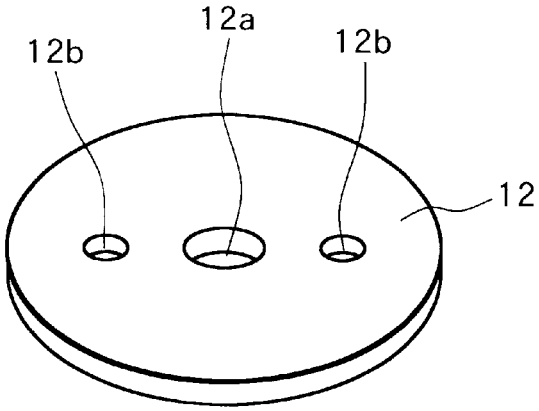
FIGS. 2*a* and 2*b* are explanatory diagrams for the manufacturing process of the transmission type X-ray tube.
Figure 2:
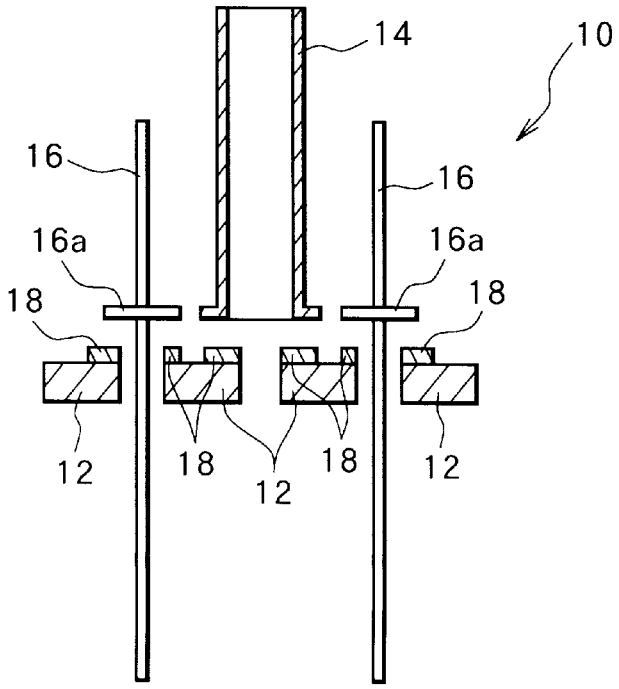
Figure 3:
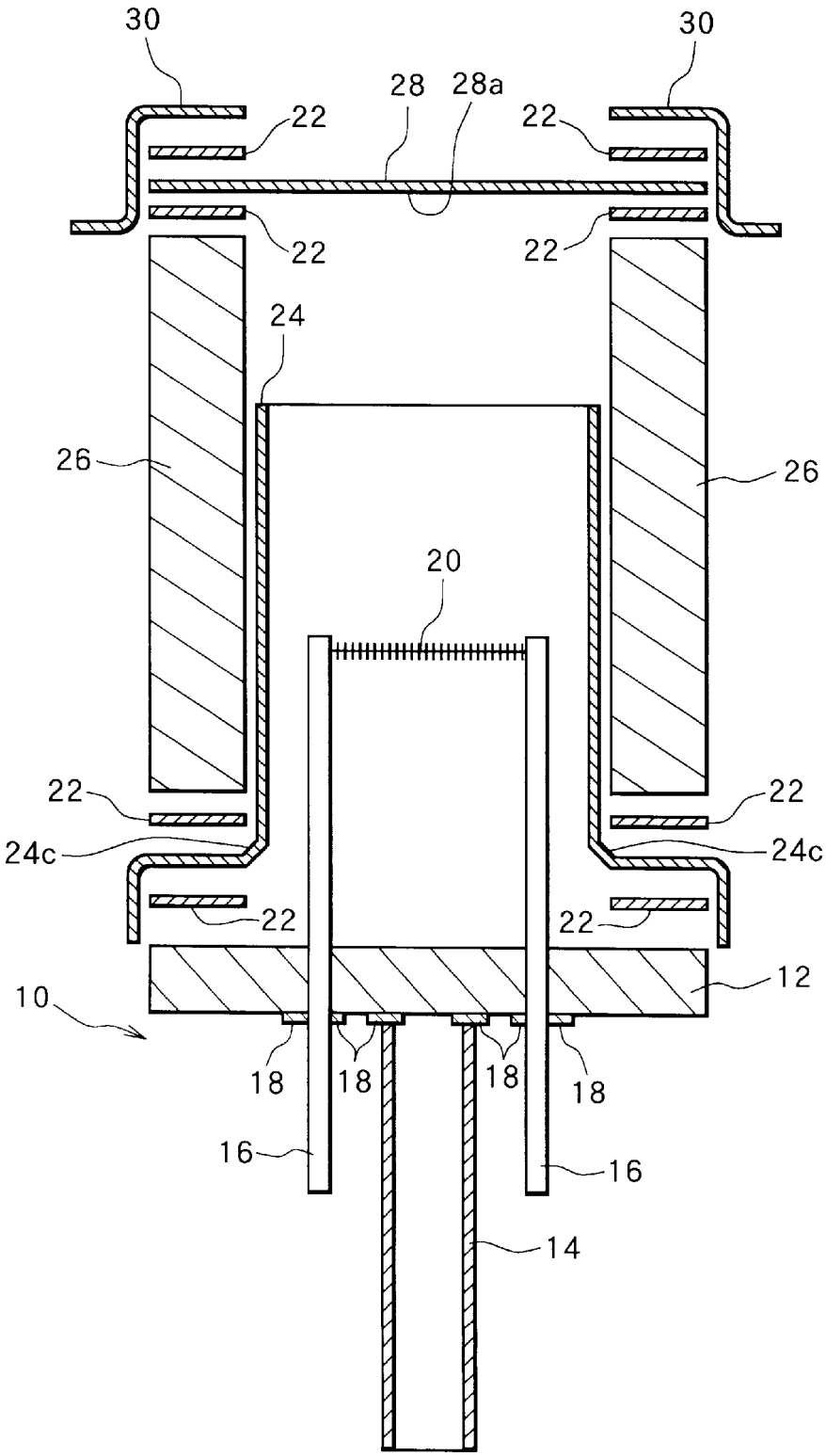
FIG. 3 is an explanatory diagram for the manufacturing process of the transmission type X-ray tube.

First, the manufacturing process of the transmission type X-ray tube of FIG. 1 will be described with reference to FIGS. 2 and 3. A stem 10 includes a disk-shaped bottom plate 12. This bottom plate 12 is manufactured by sintering aluminum powder and is formed with an exhaust bulb opening 12*a* through the center and two cathode pin openings 12*b*, one on either side of the exhaust bulb opening 12*a*, as shown in FIG. 2(*a*). An exhaust bulb 14 is joined with the exhaust bulb opening 12*a*. Also, cathode pins 16 are inserted through the cathode pin openings 12*b*. The cathode pins 16 are each formed with a flange portion 16*a*.

As shown in FIG. 2(*b*), one end of the exhaust bulb 14 is brazed to the exhaust bulb opening 12*a* of the bottom plate 12 with a high-temperature brazing material 18. The cathode pins 16 are inserted through the cathode pin openings 12*b* until the flange portions 16*a* contact the bottom plate member 12. The flange portions 16*a* are brazed to the bottom plate 12 using a high-temperature brazing material 18. In other words, high-temperature brazing material 18 is interposed between the bottom plate member 12 and one end of the exhaust bulb 14 and between the bottom plate member 12 and the flange portions 16*a* of the cathode pins 16 and held in place by jigs. Then, brazing is performed by heating the entire assembly to the brazing temperature of the high-temperature brazing material 18 in a vacuum or a hydrogen atmosphere in order to prevent oxidation. The assembly is later cooled to complete the manufacturing process of the stem 10.

The high-temperature brazing material 18 as used herein is silver solder (Ag 99.9%) having a brazing temperature of 961° C. Further, in order to perform reliable brazing, the brazing areas are metallized by coating copper (Cu), manganese (Mn), or the like, which has been melted by a binder, on the brazing areas around the exhaust bulb opening 12*a* and the cathode pin openings 12*b*.

Next, each end of a tungsten (W) coil 20 is welded to a tip of the cathode pins 16. Then, as shown in FIG. 3, the stem 10 is mounted with a focusing electrode 24, a ceramic bulb 26, an output window 28, and a conductive target voltage application cap 30, in the order given.

Figure 4:
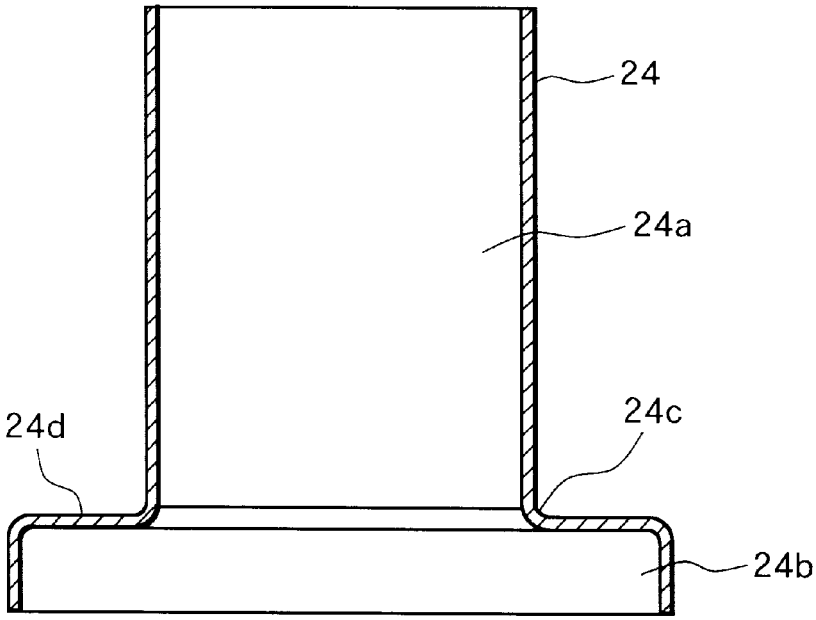
FIG. 4 is a cross-sectional view showing the vertical sections of the focusing electrode.

As shown in FIG. 4, the focusing electrode 24 is formed by pressing a Kovar metal plate, and polishing and defatting the surface of the plate. The focusing electrode 24 includes an upper cylindrical portion 24*a;* a lower cylindrical portion 24*b;* a slanted portion 24*c* provided around the circumference and between the upper cylindrical portion 24*a* and lower cylindrical portion 24*b;* and an overhang portion 24*d* extending outwardly from the slanted portion 24*c* and connecting to the lower cylindrical portion 24*b*. Here, the lower cylindrical portion 24*b* is formed with an inner diameter approximately the same as the outer diameter of the bottom plate 12. Therefore, when placing the focusing electrode 24 over the stem 10, the external periphery of the stem 10 contacts approximately the entire inner periphery of the lower cylindrical portion 24*b*.

The ceramic bulb 26 is formed by sintering aluminum powder into a cylindrical shape having an external diameter approximately equal to the external diameter of the bottom plate 12 and an internal diameter slightly larger than the external diameter of the upper cylindrical portion 24*a*. Hence, when the ceramic bulb 26 is placed over the focusing electrode 24, a gap is formed between the two. This gap is reliably formed according to the slanted portion 24*c*. In other words, when the ceramic bulb 26 is placed over the focusing electrode 24 so that the lower end of the ceramic bulb 26 is positioned over the slanted portion 24*c* of the focusing electrode 24, the lower end of the ceramic bulb 26 slips down over the slanted surface of the slanted portion 24*c* as far as the overhang portion 24*d*. By positioning the ceramic bulb 26 on the overhang portion 24*d* in this way, a gap is formed reliably between the outer surface of the upper cylindrical portion 24*a* and the inner surface of the ceramic bulb 26.

The output window 28 is formed by cutting a 0.2 mm thick amorphous carbon in a circular shape, after sand blastering the surface of the amorphous carbon. A back or inner surface 28*a* of the output window 28 is coated with a target metal, such as tungsten (W), titanium (Ti), or the like.

Figure 5:
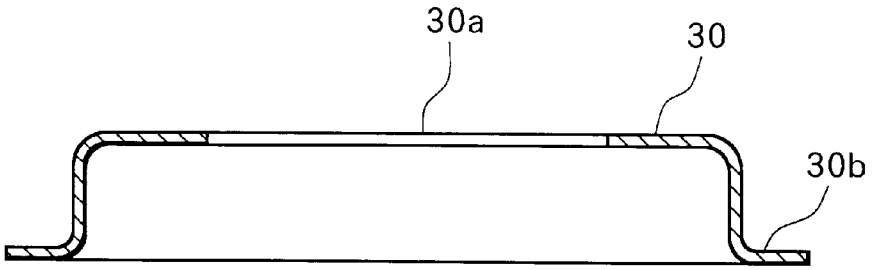
FIG. 5 is a cross-sectional view showing the vertical sections of the conductive target voltage application cap.

The conductive target voltage application cap 30 is formed by pressing a Kovar metal plate, and polishing and defatting the surface of the plate. As shown in FIG. 5, a circular window 30*a* is formed on the top portion of the conductive target voltage application cap 30 to expose the output window 28, while a flange portion 30*b* is provided on the lower portion. The conductive target voltage application cap 30 can protect the output window 28, preventing cracks and other damage from occurring in the output window 28, by positioning the conductive cap over the ceramic bulb 26 so as to cover the output window 28.

When assembling all the above described components, in order to braze various components together, a low temperature brazing material 22 is interposed between the top surface of the bottom plate 12 and the back surface of the overhang portion 24*d*; the front surface of the overhang portion 24*d* and the lower end of the ceramic bulb 26; the top end of the ceramic bulb 26 and the back surface of the output window 28; and the front surface of the output window 28 and the conductive target voltage cap 30.

The low temperature brazing material 22 as used herein is formed from silver (Ag 72%), copper (Cu 26%), and titanium (Ti 2%) and has a brazing temperature of between 780–800° C.

After all the above components have been assembled, the components are fixed together with jigs and placed in a vacuum brazing furnace. After the furnace is exhausted to the $1\times10^{-6}$ Torr level, the components are brazed at 800–850° C for 10 minutes. Hence, since the low temperature . brazing material 22 is brazed at a lower temperature than the high-temperature brazing material 18 used to manufacture the stem 10, the positions of the exhaust bulb 14 and cathode pins 16 determined in the stem 10 manufacturing process and brazed with the high-temperature brazing material 18 will not slip when performing the low temperature brazing.

Next, the vacuum brazing furnace is cooled to a temperature of 200° C. and the X-ray tube is removed from the furnace. Subsequently, the exhaust bulb 14 of the X-ray tube is connected to an exhaust device. After the gas is evacuated from the X-ray tube, and the exhaust bulb 14 is hermetically sealed, the X-ray tube manufacturing process is complete.

Figure 1:
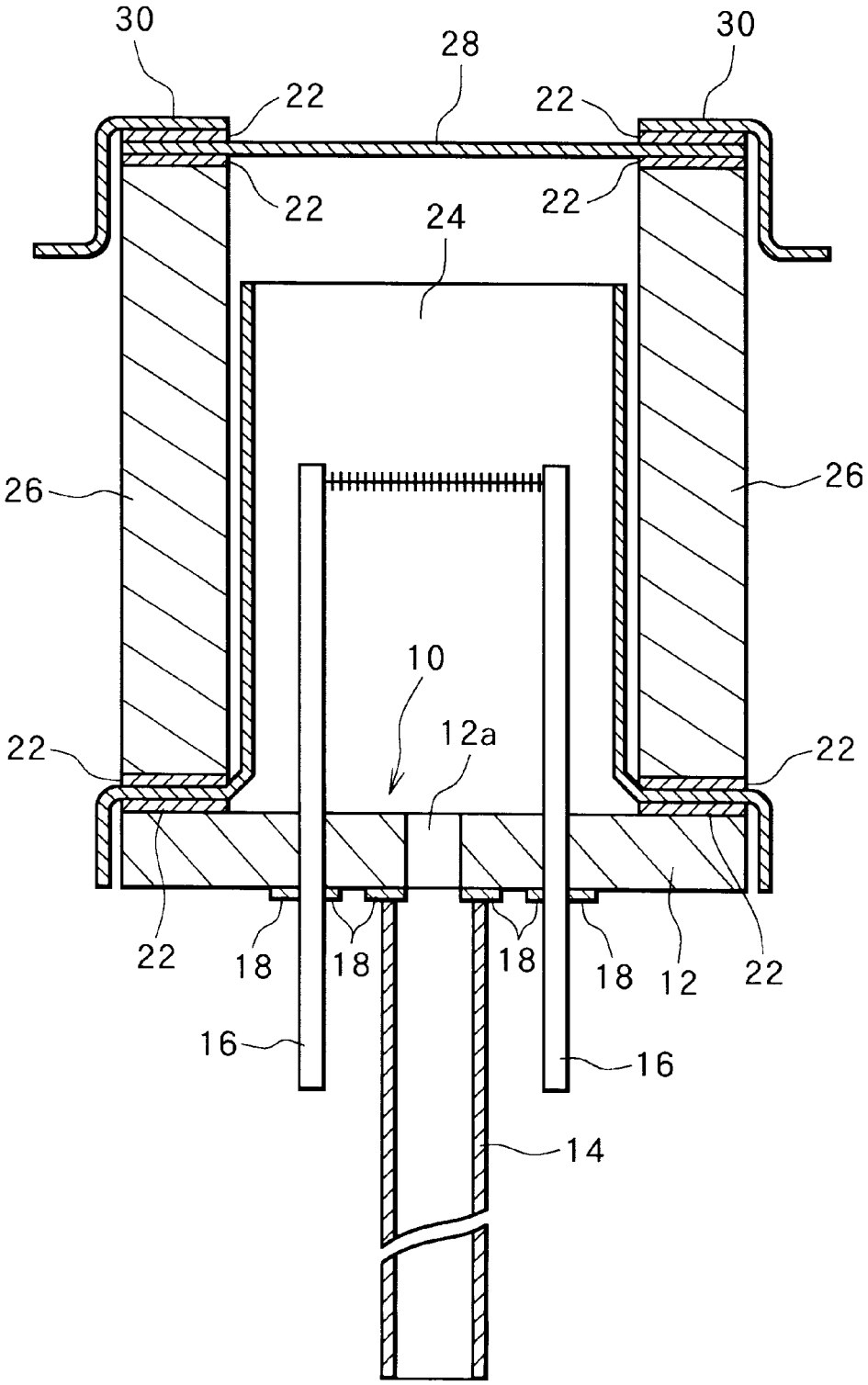
FIG. 1 is a vertical cross-sectional view of a transmission type X-ray tube according to a preferred embodiment of the present invention.

As shown in FIG. 1, the transmission type X-ray tube is constructed by interposing the lower end of the focusing electrode 24, provided along the inner surface of the ceramic bulb 26, between the top surface of the ceramic stem 10 and the lower end of the ceramic bulb 26. Therefore, not only can the size of the X-ray tube be decreased, but also mounting of the focusing electrode 24 can be performed easily, simplifying the assembly process.

The focusing electrode 24 in the X-ray tube contains a slanted portion 24*c* for separating the inner surface of the ceramic bulb 26 and the outer surface of the focusing electrode 24. Hence, the slanted portion 24*c* forms a gap between the ceramic bulb 26 and the focusing electrode 24. Further, a long distance can be reserved between the point at which the output window 28 and ceramic bulb 26 meet and the point at which the focusing electrode 24 and ceramic bulb 26 meet. As a result, voltage resistivity can be maintained.

The X-ray tube is also provided with a conductive target voltage application cap 30 for applying target voltage to the output window 28. The conductive target voltage application cap 30 can protect the output window 28 and prevent the window from cracking or incurring other damage. Also, the flange portion 30*b* of the conductive target voltage cap 30 can ensure that a reliable connection is made with the power source for applying a target voltage.

Figure 6:
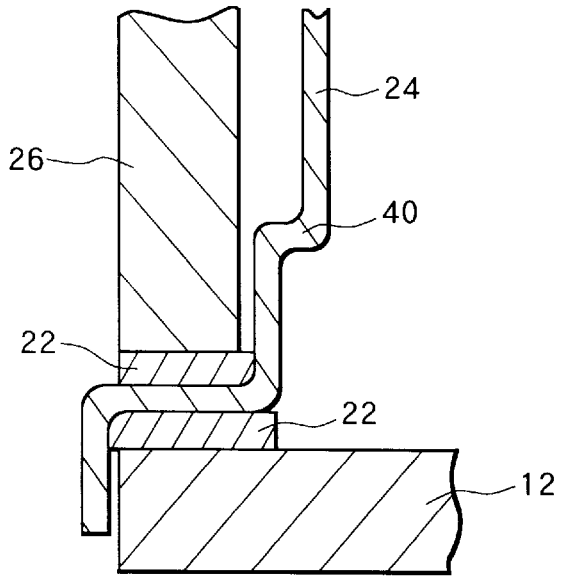
FIG. 6 is an explanatory diagram for a variation of the embodiment.

Although the present invention has been described with respect to a specific embodiment, it will be appreciated by one skilled in the art that a variety of changes and modifications may be made without departing from the scope of the invention. Although in the embodiment described above, the slanted portion 24*c* is provided on the focusing electrode 24 for separating the ceramic bulb and the focusing electrode, a stepped portion 40 could be provided on the focusing electrode 24 instead, as shown in FIG. 6. By this stepped portion 40, not only is a gap provided between the inner surface of the ceramic bulb 26 and outer surface of the focusing electrode 24, but vibrations in the focusing electrode 24 can be prevented.

Figure 7:
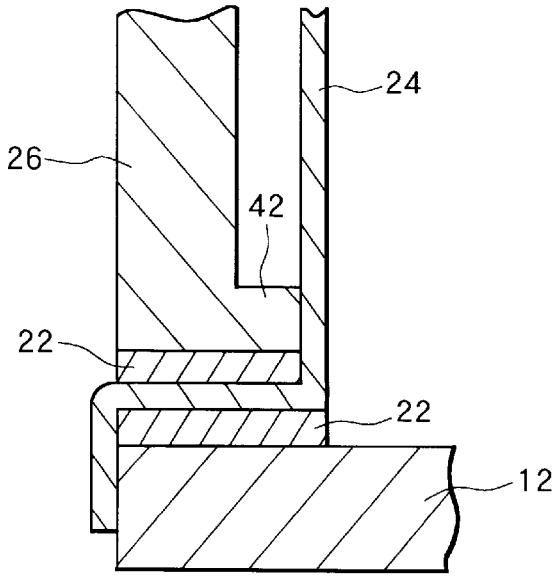
FIG. 7 is an explanatory diagram for a variation of the embodiment.

Further, a radially inwardly extending protruding portion 42 could be formed on the lower end portion of the ceramic bulb 26 for separating the ceramic bulb and the focusing electrode, as shown in FIG. 7. This protruding portion 42 can achieve the same effects as the stepped portion 40 described above.

Figure 8:
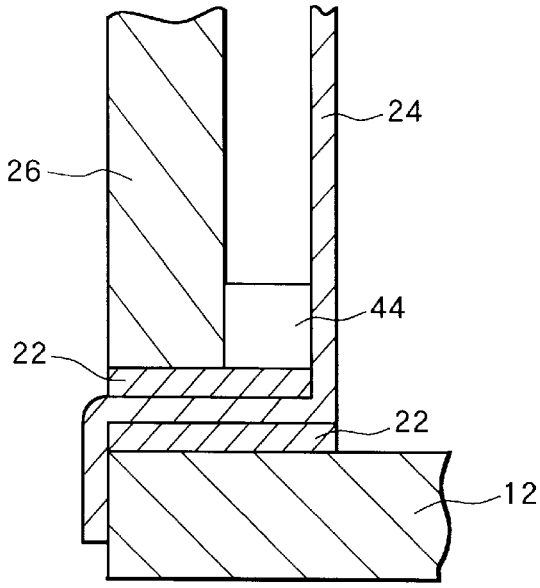
FIG. 8 is an explanatory diagram for a variation of the embodiment.
Figure 9:
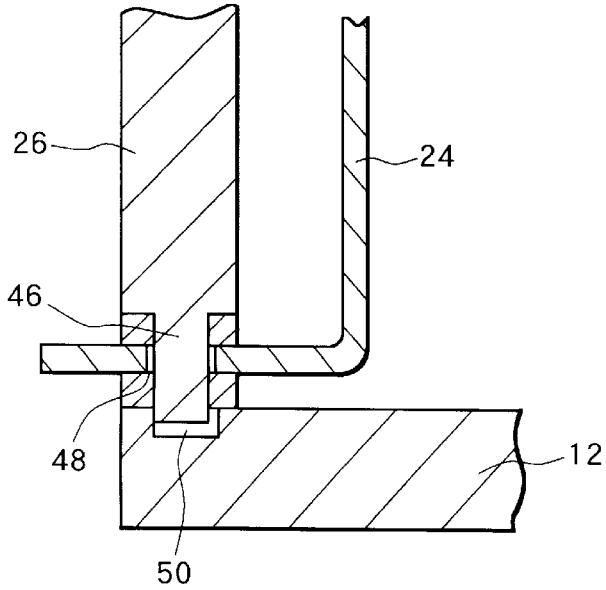
FIG. 9 is an explanatory diagram for a variation of the embodiment.

Further, a ring-shaped spacer 44 formed of ceramic or metal could be provided for separating the ceramic bulb and the focusing electrode, as shown in FIG. 8. With this ring-shaped spacer 44, the ceramic bulb and the focusing electrode can be separated without complicating the shape of either.

Further, a plurality of downwardly extending protrusions 46 could be formed on the lower end of the ceramic bulb 26 and a plurality of holes 48, through which the protrusions 46 are inserted, could be formed in the focusing electrode 24 for separating the ceramic bulb and the focusing electrode. Also, depressions 50 could be formed at corresponding positions in the bottom plate member 12, into which depressions the protrusions 46 are fitted.

Figure 10:
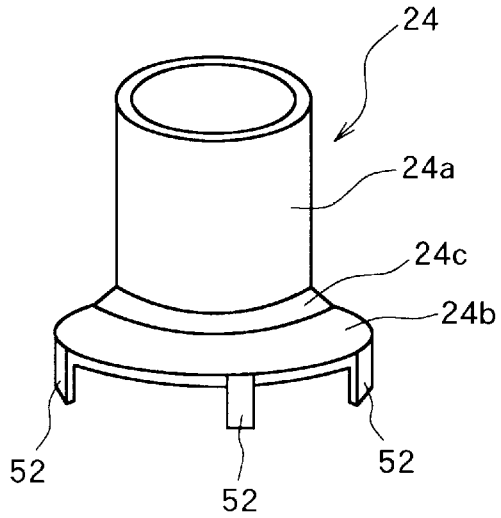
FIG. 10 is an explanatory diagram for a variation of the focusing electrode of the embodiment.

In the embodiment described above, the focusing electrode 24 is fixed to the stem 10 by intimately contacting the inner surface of the lower cylindrical portion 24*b* of the focusing electrode 24 to the outer surface of the bottom plate member 12 of the stem 10. However, It is also possible to fix these two components by providing pawls 52 on the focusing electrode 24, as shown in FIG. 10.

In the embodiment described above, the upper cylindrical portion 24*a* of the focusing electrode 24 is formed from Kovar metal as a cylindrical wall, but this cylindrical wall can also be formed as a mesh. This mesh formation can increase the effectiveness of exhausting the ceramic bulb 26.

Figure 11:
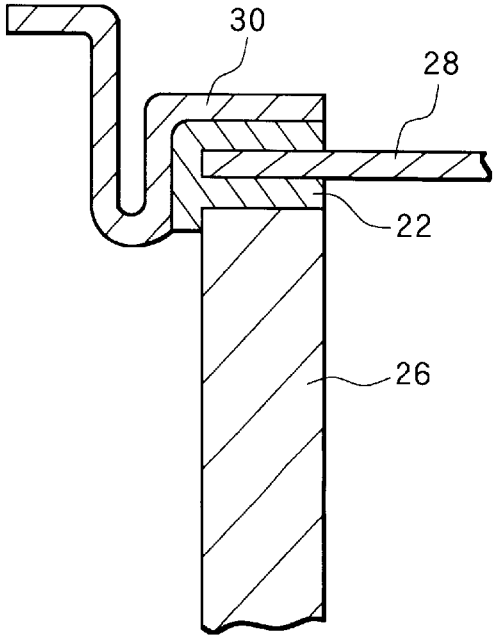
FIG. 11 is an explanatory diagram for a variation of the conductive target voltage application cap of the embodiment.
Figure 12:
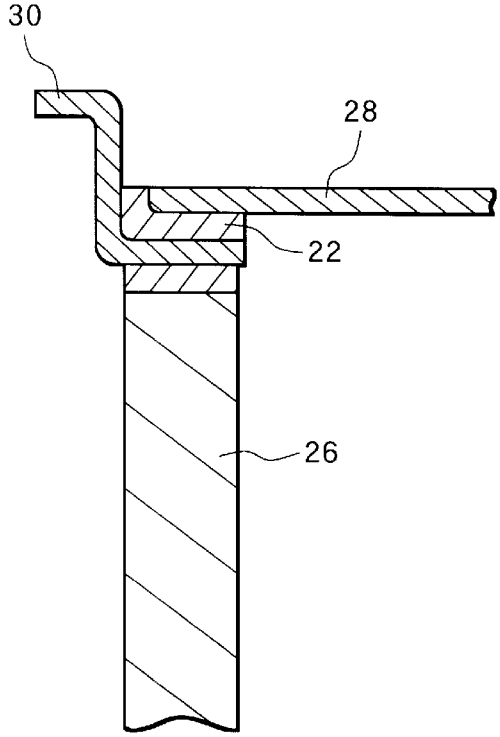
FIG. 12 is an explanatory diagram for a variation of the conductive target voltage application cap of the embodiment.
Figure 13:
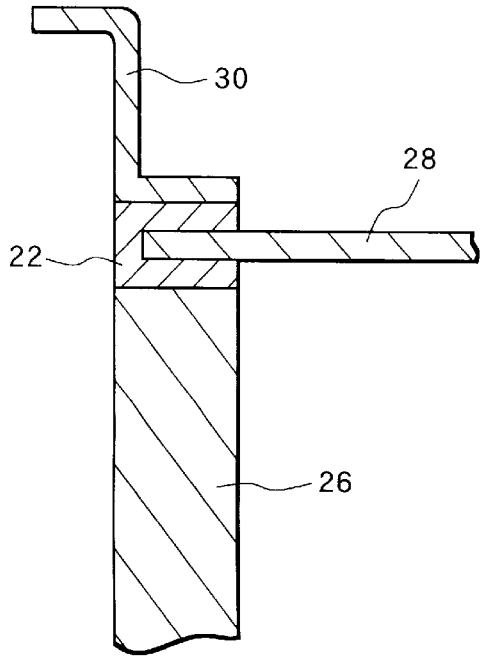
FIG. 13 is an explanatory diagram for a variation of the conductive target voltage application cap of the embodiment.
Figure 14:
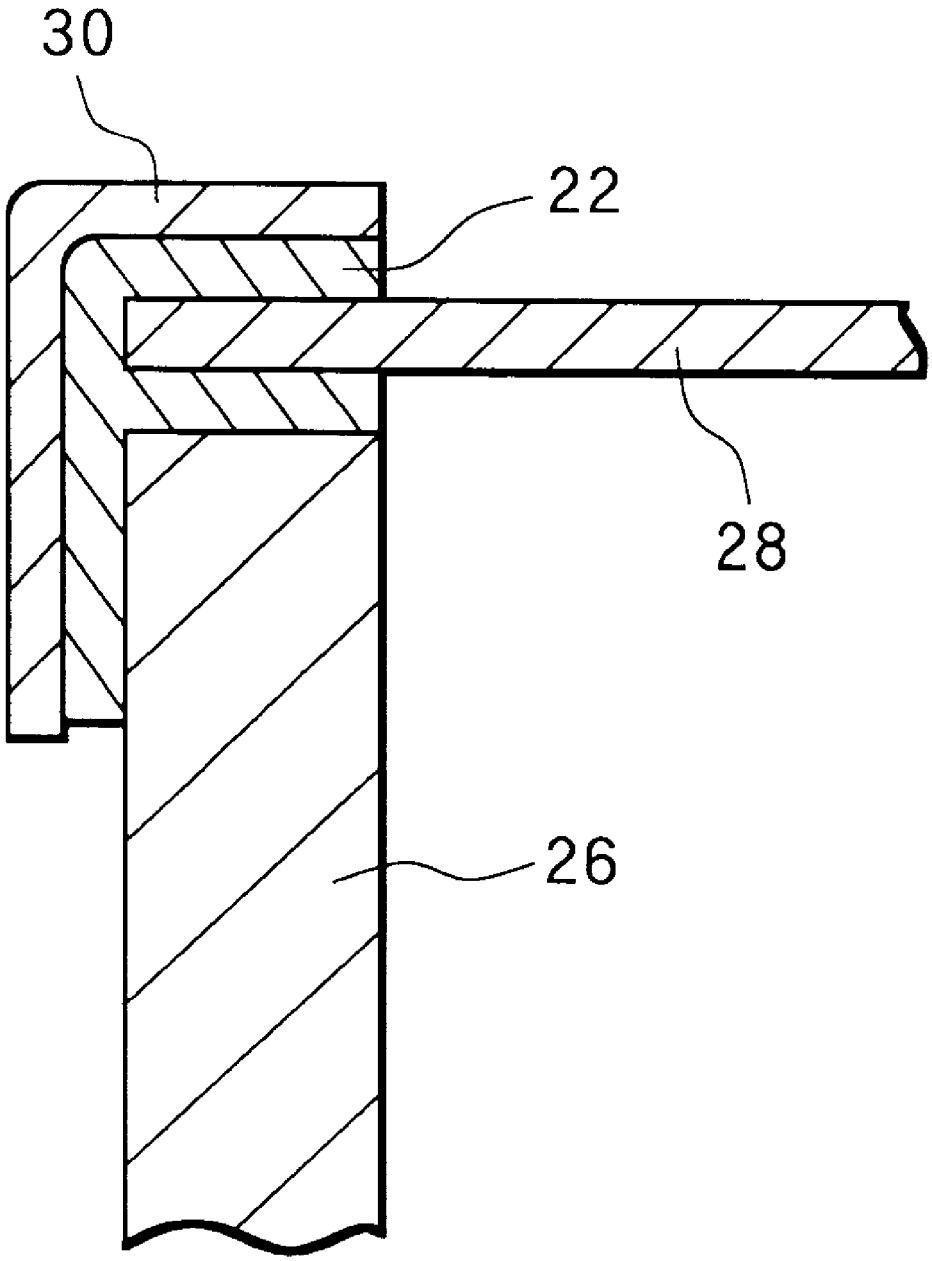
FIG. 14 is an explanatory diagram for a variation of the conductive target voltage application cap of the embodiment.

In the embodiment described above, a conductive target voltage application cap 30 shaped as shown in FIG. 5 is used. However, it is also possible to use a conductive target voltage application cap 30 shaped as shown in FIGS. 11, 12, and 14. The conductive target voltage application cap 30 shown in FIG. 13 is shaped the same as the conductive target voltage application cap 30 shown in FIG. 12, but the output window 28 is positioned below the conductive target voltage application cap 30 in FIG. 13.

In the embodiment described above, silver solder (Ag 99.9%) is used as the high-temperature brazing material 18 and a solder composed of silver (72%), copper (26%), and titanium (2%) is used as the low-temperature brazing material 22. However, the high-temperature brazing material 18 can be any brazing material having a brazing temperature higher than the low-temperature brazing material 22, while the low-temperature brazing material 22 can be any brazing material having a brazing temperature lower than the high-temperature brazing material 18. Hence, silver-copper solder (brazing temperature of 780–900° C.), brass solder (brazing temperature of 800–935° C.), copper solder (brazing temperature of 1,083° C.), nickel solder (brazing temperature of 975–1,070° C.), and gold solder (brazing temperature of 1,064° C.) can be used as the high-temperature brazing material 18. For the low-temperature brazing material 22, brazing material composed of silver (Ag). copper (Cu), lead (Sn), and titanium (Ti) (brazing temperature of 620–750° C.), brazing material composed of silver (Ag), copper (Cu), indium (In), and titanium (Ti) (brazing temperature of 620–710° C.), and the like can be used, providing the brazing temperature of the chosen brazing material is lower than that of the chosen high-temperature brazing material 18.

A transmission type X-ray tube according to the present invention is configured with the lower end of the focusing electrode, provided along the inner surface of the ceramic bulb, interposed between the top surface of the ceramic stem and the bottom end of the ceramic bulb. As a result, not only can the size of the X-ray tube be reduced, but mounting of the focusing electrode can also be made easier, thereby simplifying assembly operations.

By providing a conductive target voltage application cap for applying target voltage to the output window, the conductive target voltage application cap can protect the output window and prevent it from cracking or otherwise incurring damage. Also, the conductive cap can prevent the output window from slipping due to vibrations when brazing the output window to the ceramic bulb.

By providing a means for separating the inner surface of the ceramic bulb from the outer surface of the focusing electrode, a gap is formed between the ceramic bulb and the focusing electrode. Further, a long distance can be reserved between the point at which the output window and ceramic bulb meet and the point at which the focusing electrode and ceramic bulb meet. As a result, voltage resistivity can be maintained.

What is claimed is:

1. An X-ray tube comprising:

a ceramic bulb of a tubular configuration extending in an axial direction and having an inner peripheral surface, an outer peripheral surface, a first and, and a second end opposite the first and;

a stem secured to the first and of said ceramic bulb;

an output window secured to the second end of said ceramic bulb, said output window having a first surface deposited with a target metal and confronting said stem and a second surface from which X-rays are output, said ceramic bulb, said stem and said output window defining an airtight chamber having an inner space;

a cathode disposed in the inner space of the airtight chamber;

a focusing electrode including a tubular portion having an inner peripheral surface and an outer peripheral surface, the tubular portion being disposed in the inner space and along the inner peripheral surface of said ceramic bulb to have a space between the inner peripheral surf ace of said ceramic bulb and the outer peripheral surface of the tubular portion, said focusing electrode further including a lower end portion interposed between said stem and the first end of said ceramic bulb.

2. The X-ray tube according to claim 1, further comprising separation means for separating the inner peripheral surface of said ceramic bulb and the outer peripheral surface of said focusing electrode.

3. The X-ray tube according to claim 2, wherein said separation means is integrally formed with said focusing electrode between the tubular portion and the lower end portion.

4. The X-ray tube according to claim 3, wherein said separation means has a slanting surface slanted with respect to the axial direction.

5. The X-ray tube according to claim 3, wherein said separation means has a stepped surface extending in a direction substantially perpendicular to the axial direction.

6. The X-ray tube according to claim 2, wherein said separation means is integrally formed with said ceramic bulb.

7. The X-ray tube according to claim 6, wherein said separation means is formed to the first end of said ceramic bulb and extends toward the inner space.

8. The X-ray tube according to claim 7, wherein said separation means is in abutment with the outer peripheral surface of said focusing electrode.

9. The X-ray tube according to claim 2, wherein said separation means is formed in said ceramic bulb and said stem, said separation means engaging said ceramic bulb and said stem while fixedly interposing the lower end portion of said focusing electrode therebetween.

10. The X-ray tube according to claim 9, wherein said ceramic bulb is formed with a plurality of protrusions at the first end, the lower end portion of said focusing electrode is formed with a plurality of through-holes corresponding to the plurality of protrusions, and said stem is formed with a plurality of depressions corresponding to the plurality of protrusions, wherein the plurality of protrusions are engageable with the plurality of depressions through the plurality of through-holes in one-to-one correspondence with one another.

11. The X-ray tube according to claim 2, wherein said separation means comprises a ring spacer disposed between the inner peripheral surface of said ceramic bulb and the outer peripheral surface of said focusing electrode.

12. The X-ray tube according to claim 1, further comprising a target voltage application member that is electrically connected to said output window, a target voltage being applied to said output window through said target voltage application member.

13. The X-ray tube according to claim 12, wherein said output window is a circular shape having a radially outer end portion that is interposed between said target voltage application member and the second end of said ceramic bulb.

14. The X-ray tube according to claim 12, wherein said target voltage application member is partly interposed between said output window and the second end of said ceramic bulb.

15. The X-ray tube according to claim 1, wherein said cathode comprises a pair of cathode pins extending into the inner space through said stem, and a coil connecting said pair of cathode pins in the inner space.

* * * * *